United States Patent [19]

Svantesson

[11] Patent Number: 4,848,226

[45] Date of Patent: Jul. 18, 1989

[54] MATERIAL GRIPPING ARRANGEMENT FOR STENCIL PRINTING MACHINE

[76] Inventor: Ake Svantesson, Apertado 36, Fuengirola Malaga, Spain

[21] Appl. No.: 654,524

[22] Filed: Sep. 25, 1984

Related U.S. Application Data

[63] Continuation of Ser. No. 458,170, Jan. 14, 1983, abandoned.

[30] Foreign Application Priority Data

Jan. 19, 1982 [SE] Sweden ..... 8200276

[51] Int. Cl.[4] ..... B41F 15/16

[52] U.S. Cl. ..... 101/126

[58] Field of Search ..... 101/123, 126

[56] References Cited

U.S. PATENT DOCUMENTS

| | | | |
|---|---|---|---|
| 836,483 | 11/1906 | Burdick | 101/123 |
| 2,609,747 | 9/1952 | Schwartz | 101/115 |
| 2,690,118 | 9/1954 | Schwartz | 101/123 |
| 3,075,651 | 1/1963 | Kaden | 414/753 |
| 3,180,253 | 4/1965 | Hildmann | 101/316 |
| 3,215,071 | 11/1965 | Stillwell | 101/126 |
| 3,577,914 | 5/1971 | Ronge | 101/124 |
| 3,754,667 | 8/1973 | Storch | 414/751 |
| 3,812,779 | 5/1974 | Cobb | 101/193 |
| 3,861,520 | 1/1975 | Ballard | 414/751 |
| 3,885,680 | 5/1975 | Rasenberger | 414/751 |
| 3,910,422 | 10/1975 | Zierpka | 414/751 |
| 3,980,182 | 9/1976 | Esser | 414/751 |
| 4,003,476 | 1/1977 | Laskey | 101/114 |
| 4,032,018 | 6/1977 | Wallis | 414/751 |
| 4,058,307 | 11/1977 | Bubley | 101/123 |
| 4,094,242 | 6/1978 | Ichinose | 101/123 |

FOREIGN PATENT DOCUMENTS

| | | | |
|---|---|---|---|
| 2756417 | 6/1978 | Fed. Rep. of Germany | 414/751 |
| 93552 | 7/1981 | Japan | 101/126 |
| 631363 | 11/1978 | U.S.S.R. | 101/114 |
| 469910 | 8/1937 | United Kingdom | 271/85 |

*Primary Examiner*—Clifford D. Crowder

*Attorney, Agent, or Firm*—Burns, Doane, Swecker & Mathis

[57] ABSTRACT

Stencil printing machine including a printing table, a number of movably arranged material gripping and displacement arrangements, a stencil tensioned in a frame and located above the printing table and a doctor blade arrangement which can interact with the stencil. At least one material gripping and displacement arrangement has imparted to it a reciprocating motion between two predetermined positions. One position for gripping and fetching material intended for printing and a second position for placing the fetched material on the printing table. The position of the arrangmeent is registered in both the first and the second position.

3 Claims, 1 Drawing Sheet

MATERIAL GRIPPING ARRANGEMENT FOR STENCIL PRINTING MACHINE

This is a continuation of application Ser. No. 458,170 filed Jan. 14, 1983, now abandoned.

FIELD OF INVENTION

The present invention relates to a stencil printing machine which includes a printing table, a number of movably arranged material gripping and displacement arrangements, a stencil tensioned in a frame and placed above the printing table and a doctor blade arrangement which can interact with the stencil.

BACKGROUND OF THE INVENTION

Stencil printing machines of the type mentioned above are as such already known which provide an adjustment arrangement for material gripping and displacement arrangements, usually designated as gripper beams. This adjustment arrangement is intended to impart a precise position to the gripper beams in relation to a printing table in the printing machine. The gripper beams include members for gripping and displacing a material. For their movement the gripper beams interact with at least one, preferably two, endless feed chains or the like, which are arranged in parallel. These cease to move when the gripper beams are located in predetermined positions, one for the gripper beam to grip a sheet or material intended for printing, and one for the gripper beam to hold or leave a sheet in a position for application of print to the sheet. The gripper beams can be made adjustable by means of a double lever arm system so that the gripper beams adopt precisely the said predetermined positions, by providing the end surfaces of the gripper beams and the outer ends of a double lever arm system with interacting members.

Here the members comprise on the one hand convex, preferably cylindrical or spherical surfaces and secondly preferably "V"-shaped recesses which are intended to be pressed against each other in the predetermined position.

An adjustment arrangement of the type mentioned above has been described previously in British patent specification No. 1,208,614.

It is already known that the drive for the gripper beams described above with endless drive chains arranged in parallel becomes extremely complicated, because it is not only a question of driving the chains intermittently so that the gripper beams stop in predetermined positions, but furthermore tensioning arrangements are required for the chains and also other mechanical members. Furthermore it is known that a drive arrangement for gripper beams of the type mentioned above has to be dimensioned for high power input, because the construction as a whole becomes heavy and the acceleration and retardation moments require high power inputs.

There has long been a desire to be able to create conditions such that the drive arrangement for the gripper beams is made simple, while at the same time the gripper beam design is made light and simple, thereby making it possible to displace the gripper beams rapidly between two predetermined positions without excessive consumption of power.

Furthermore it is a difficult technical problem to create conditions such that the transport speed of the gripper beams is easily capable of regulation, for example so that the gripper beam is subjected to high acceleration, high velocity and a somewhat reduced retardation.

Furthermore there has been a desire, and this represents a difficult technical problem, to create conditions such that in connection with stencil printing machines, the material provided with a printed image can be delivered easily. It is particularly advantageous if special delivery belts and special delivery fingers can be eliminated.

A particular problem which has been encountered with stencil printing machines, especially with such stencil printing machines that function at high printing speeds, is that the insertion time for material intended to be printed to reach the insertion position is short and this becomes particularly difficult when insertion is carried out manually.

OBJECTS AND SUMMARY OF THE INVENTION

Consequently it is a particular requirement that on stencil printing machines functioning with short printing times it should be possible to create the longest possible insertion times. This would be particularly advantageous if the entire, or almost the entire printing time, could be utilised as insertion time.

It is also a particular requirement to create conditions such that the material intended for printing can either be taken automatically from an inserter or direct from a feed stack so as to be gripped by the gripper beam, or else the material can be inserted by hand and registered in an insertion position.

It is also a particular requirement to create conditions such that the transport speed of the gripper beams can be regulated in a simple manner, and particularly to be infinitely-variably regulated, and it is particularly advisable to provide a very rapid reciprocating movement of the gripper beams.

These and other objects are accomplished by a construction of a stencil printing machine of the type mentioned above and which possesses the feature that at least one material gripping and displacement arrangement has imparted to it a reciprocating movement between two predetermined positions, an initial position for gripping and fetching material intended for printing and a second position for placing material which has been fetched onto the printing table, and that the position of the arrangement is registered in both the initial and the second position.

The invention also is characterised by the fact that at least two material grippings and displacement arrangements are combined with each other, while at the same time these arrangements are controlled to give a reciprocating movement. In an initial position one arrangement is designed to grip a first item of material intended for printing in its insertion position, and the second arrangement is intended to grip another item of material provided with print in its printing position.

When the arrangements are located in a second position, one arrangement is designed to leave the first item of material intended for printing in its printing position and the second arrangement is designed to hand over a second item of material provided with print to a delivery position.

The invention is also characterised by the fact that the arrangements can be displaceably installed along two parallel-orientated guides, one arrangement being registered during the gripping of the material intended for printing in the insertion position, while the second arrangement can be registered on placing the material into the printing position.

By arranging the insertion position above the printing position, while at the same time the arrangements are displaceably mounted along two parallel guides, a simple construction is achieved.

The invention is also characterised by the possibility of having three or more material gripping and displacement arrangements being firmly connected to each other during one reciprocating movement. In such a case it is proposed that in an initial position one arrangement be designed to grip an initial item of material intended for printing in its insertion position, while the other arrangements are intended to each grip further items of material provided with printed image in their respective printing position. In a second position one arrangement is, like the remainder apart from the last, designed to leave each of the respective items of material in its printing position, while the last arrangement is intended to hand over an item of material provided with a printed image (multiple printing) to a delivery position.

By means of this arrangement it is possible to undertake multi-colour printing and different printing positions on the same material. It is furthermore proposed that the pivoting movement or swinging movement of the guides up and down take place via a cam disc which is driven by the stencil machine drive machinery. The invention also relates to an alternative, where the printing table will be displaceably arranged so that it can move upwards and downwards, in its upper position being capable of providing support for the material in the printing position. Finally, as an alternative, the material gripping and displacement arrangement can be raised and lowered.

The main advantages which can be perceived as being linked with a stencil printing machine in accordance with the present invention are that the design of the gripper beams and its drive machinery can be made much simpler than with previously known machines, while at the same time the machine is made of light construction thus permitting rapid movement of the gripper beams between different predetermined positions and this rapid movement can take place without the consumption of large quantities of power and energy.

BRIEF DESCRIPTION OF DRAWINGS

A more detailed description will be given by reference to the appended drawings of a number of proposed embodiments which exhibit the characteristic features of the present invention, where.

DESCRIPTION OF PREFERRED EMBODIMENTS

Figure 1:
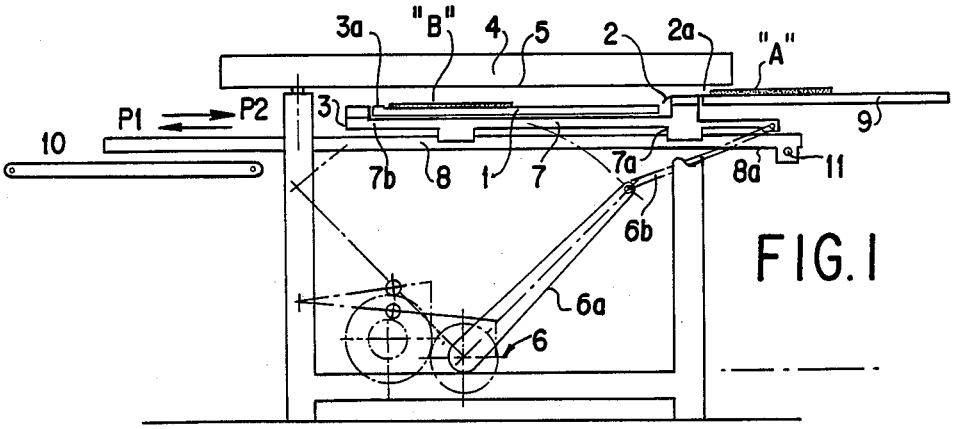
FIG. 1 is a side view and in greatly simplified fashion the principle of a stencil printing machine operating in accordance with the theory of the invention and with a guide which is capable of swivelling at one end occupying its upper position.

With reference to FIG. 1, this shows in a side view and in a greatly simplified form a stencil printing machine in accordance with the present invention.

The stencil printing machine includes a printing table 1, two movably arranged material gripping and displacement arrangements as comprising first and second gripper beams 2 and 3, a blanket 5 which is tensioned in a frame 4 upon which a stencil is applied. The blankets is located directly above the printing Table 1. A conventional doctor blade and ink filling arrangement, which are not shown, interact with the stencil 5.

FIG. 1 illustrates a drive mechanism 6 which is intended via an arm *6a* and a connecting arm *6b* to displace the gripper beams 2 and 3 in a reciprocating movement. A beam 7 is fastened at one end *7a* to the gripper beam 2. The other end *7b* is attached to the gripper beam 3, such that the gripper beams 2 and 3 can be displaced along a guide 8, to and fro, as indicated by the arrows P1 and P2 by including drive mechanisms 6, *6a* and 6b. Conventional means, shown in broken lines adjacent mechanism 6, control and impart the required movements to the gripper beam 2 between two stop positions.

In an initial position shown in FIG. 1, the gripping member *2a* of one gripper beam 2 is designed to grip an initial item of material "A" which is located in an insertion position, in the embodiment resting on a Table 9.

Figure 2:
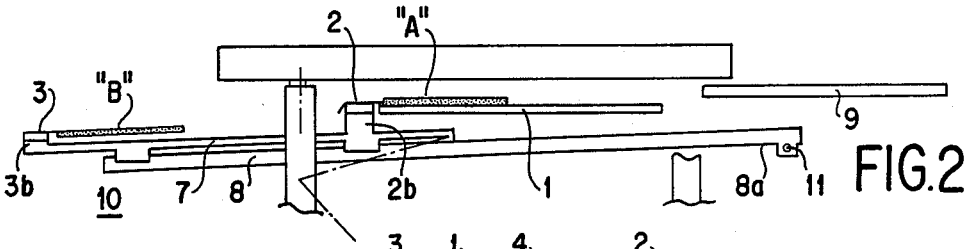
FIG. 2 is a view of a machine in accordance with FIG. 1 with the guide in a lower position.

The second gripper beam 3 is intended, using its gripper member *3a*, to grip another item of material "B" located in a printing position to be provided with a printed image in the printing position by a doctor blade arrangement being displaced along the stencil 5 and pressing printing ink which is present on the upper face of the stencil through the blanket 5 so as to form a coating or a printed image on the material "B". When the gripper beams 2 and 3 have each gripped their material "A" and "B" the gripper beams 2 and 3 are displaced to a second position. In this position as shown in FIG. 2 one of the gripper beams 2 is designed to leave the first item of material "A" intended for printing in the printing position for printing Table 1, whilst the second gripper beam 3 is designed to hand over the printed material "B" to a delivery position. This delivery position has been given the reference notation number 10.

In the diagrams reference is made solely to one guide 8 and one beam 7 but obviously two parallel-orientated guides 8 and between them two parallel-orientated beams 7 may be provided to insure stability as regards the displacement of the gripper beams 2 and 3.

To ensure that the gripper beams 2 and 3 adopt a precise position in relation to the frame of the stencil printing machine, the gripper beam 2 should be registered when gripping the material "A" in the insertion position 9 as shown in FIG. 1, and that gripper beam 2 must be registered when leaving the material "A" in the printing position 1 as shown in FIG. 2.

Pivoting of the guides around the pivot 11, upwardly and downwardly takes place via a cam disc which is driven by the printing machine drive machinery, schematically shown in the broken line mechanism adjacent drive means 6.

The gripper beams 2 and 3 are shown joined to each other via the beam 7. It can be advisable to make the supports to *2b* and *3b* somewhat resilient, by this means committing the adjustment and registration of the gripper beam in its position.

The example forming the embodiment illustrates that the insertion position 9 is orientated some distance above the printing position 1 and that the gripper beams are displaceably arranged along two parallel guides 8. However, at one end surface *8a* these guides 8 can pivot to some extent about pivot 11 which means that it should be possible to impart to the gripper beam 2 a horizontal or at least essentially horizontal movement from the insertion position 9 to the printing position, whereby the gripper beam drops downwardly to the printing position so that the material can be made to rest against the printing table 1.

In an alternate embodiment of the invention three or more material gripping and displacement arrangements or gripper beams 2, 3 are joined to each other during their reciprocating movement, thus allowing several prints to be made simultaneously. In such a case the delivery position 10 is modified to be a printing table. The printing Table 1 is used to apply an initial color to the material "B" while the printing table at 10 applies a second color to the same material. In the first position illustrated in FIG. 1, one of the gripper beams 2 is intended to grip an initial material "A" in its insertion position 9 while the remaining gripper beams are intended each to grip other material in their respective printing positions. The gripper beam 3 grips the material "B" at the printing Table 1, while the next gripper beam (not shown) grips the material which has been printed at a printing table located at 10.

In the second position one of the gripper beams 2 and the remainder, apart from the last, are each intended to leave their respective materials in their printing position. The last gripper beam is intended to hand over a printed material to a delivery position.

Figure 3:
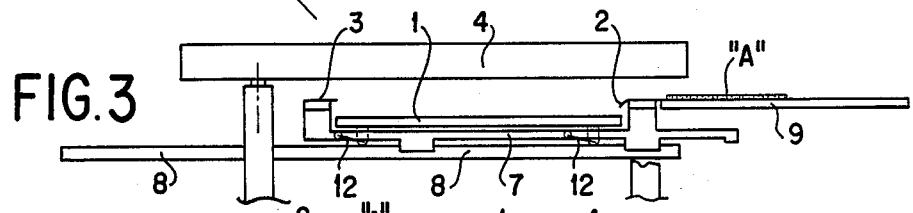
FIG. 3 is a side view and in greatly simplified fashion the principle of a stencil printing machine operating in accordance with the theory of the invention and with a printing table which is capable of being raised and lowered occupying its lower position.
Figure 4:
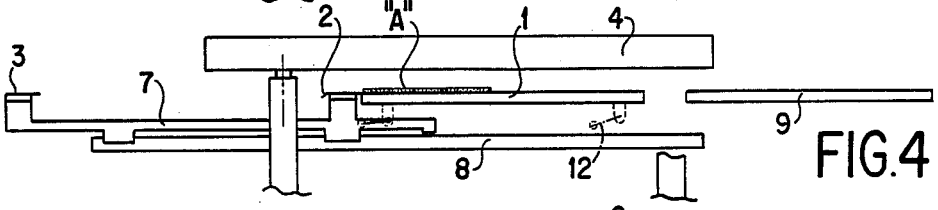
FIG. 4 is a side view of the machine in accordance with FIG. 3 where the printing table is in its upper position.

With reference to FIG. 3 and 4, an embodiment is shown where the printing Table 1 can be raised and lowered.

The printing Table 1, is shown best in FIG. 4 and is supported by a parallel link system 12 and by this means the printing table can adopt a lower position as shown in FIG. 3 and an upper position as in FIG. 4.

During the period when the gripper beam 2 displaces the material "A" intended for printing from the insertion position 9 to the printing position on printing Table 1, the printing table is located in a lower position and permits the gripper beam 2 to pass across the printing Table 1 along fixed guides 8.

However when gripper beam 2 adopts the position shown in FIG. 4 and the material "A" is located above the printing Table 1, the printing Table 1 is raised to the position illustrated in FIG. 4 and print can be applied to the material "A".

The printing Table 1 is lowered and the gripper beam 2 reverts to the position shown in FIG. 3 in order to fetch new material at the insertion position 9 with the first gripper beam 2 while at the same time the gripper beam 3, after raising of the printing table, grips the printed material.

During further displacement of the gripper beams 2 and 3 to the left, the gripper beam 3 removes the printed material from the printing table while gripper beam 2 locates a new item of material intended to be printed on printing Table 1.

Referring to FIGS. 3 and 4, it is to be appreciated that the gripping bars 2 and 3 are spaced apart along the beam 7 by a distance corresponding with the distance between the printing Table 1 and the second Table 9, and that the beam reciprocates according to a forward distance and a rearward distance equal to the aforementioned distance between the printing Table 1 and the second Table 9. It is also noteworthy that the printing Table 1 and the second Table 9 lie within a common plane and that the first gripper bar 2 remains approximately within that common plane throughout its entire movement in this embodiment.

Figure 5:
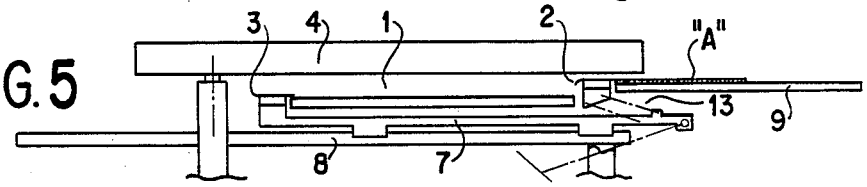
FIG. 5 is a side view and in greatly simplified fashion the principle of a stencil printing machine operating in accordance with the theory of the invention with a gripper beam capable of being raised and lowered occupying its upper position and FIG. 6 is a side view of the machine in accordance with FIG. 5 with the gripper beam in its lower position.
Figure 6:
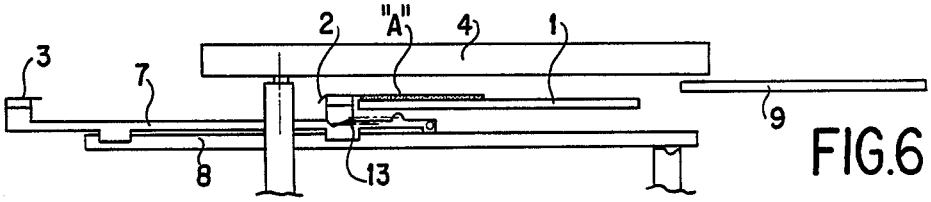

FIG. 5 and 6 illustrate an embodiment where the gripper beams, particularly gripper beam 2, can be raised and lowered.

With reference to FIGS. 5 and 6, there is a fixed delivery Table 9 and a fixed printing Table 1 together with fixed orientation of the guides 8.

The gripper beam 2 is attached to beam 7 via a system of parallel rods 13 so that as illustrated in FIG. 5, the gripper beam 2 can adopt an upper position so as to grip a material "A" intended for printing. Gripper beam 2 adopts this upper position during its displacement along the fixed guides 8 to the printing position above printing Table 1, after which gripper beam 2 is dropped down to its lower position as shown in FIG. 6 and here places the material "A" intended for printing in the printing position on the fixed printing Table 1.

Otherwise the sequence is the same as for the embodiments previously described.

Even though the specification includes three embodiments which have been described separately, it should be borne in mind that a combination of two or several embodiments can also satisfy the inventive concept.

As previously mentioned the principle underlying the invention can also be utilised for one gripper beam 2. After registration, this grips in the insertion position 9 and transports the material "A" to printing Table 1. Here the gripper beam 2 is registered once again and the material is fastened to the printing table. Then the gripper beam can revert to the insertion position 9.

Now, during the entire printing stage, it is possible to adjust the material intended for printing to the registration mark in the insertion position.

Naturally the invention is not restricted to the embodiments cited above by way of example but can also be subjected to modifications within the framework of the following patent claims.

It is to be expected that the embodiment shown in FIGS. 3 and 4 is especially preferred. This embodiment has an upper frame 4, in which the stencil is arranged and supported in a well known manner together with an ink filler and a doctor blade (not shown), which may reciprocate along the stencil and in only one direction of movement press the ink through apertures in the stencil, said apertures forming the pattern to be printed onto the material "A".

The frame 4, together with the ink filler and the doctor blade and the stencil is movably arranged up and down and so controlled in the movement that in the upper position the material "A" is transported by the gripper 2 along the printing Table 1 (from the position shown in FIG. 3. to the position shown in FIG. 4).

During this transportation the printing table is in its lower position.

Then the frame 4 is moved to its lower position and the printing table is moved to its upper position and in these positions the printing sequence may start.

Due to the fact that the gripper 2 has an upper smooth surface (plane surface) lying more or less in the same plane as the material "A", when rested upon the printing table, it is possible to print the material "A" when said material is gripped by the gripper 2, and further to start the printing and its printing pattern adjacent the edge of the material and adjacent the gripper 2. The gripper 2 serves as registering device of the material on the Table 1.

It is to be understood that the present invention may be embodied in other specific forms without departing from the spirit or essential characteristics of the present invention. The preferred embodiments are therefore to be considered illustrative and not restrictive. The scope of the invention is indicated by the appended claims rather than by the foregoing descriptions and all changes or variations which fall within the meaning and range of the claims are intended to be embraced therein.

What is claimed is:

1. A stencil printing machine printing machine comprising: a printing table movable between a lower position and a raised printing position where printing of material occurs; first and second material gripping arrangements; a stencil frame for tensioning a stencil above the printing table, said stencil frame being movable toward and away from said printing table; means for positioning material at an insertion position, said positioning means being in a plane common with said printing table when said printing table is at said printing position, said positioning means being spaced a predetermined distance from said printing table when said table is at said printing position; a beam and fixed means for guiding said beam member colinearly along a path extending substantially parallel to said printing table; said first and second material gripping arrangements being joined to said beam to form an assembly ofarrangements, said material gripping arrangements being spaced apart along said beam according to said predetermined distance, said beam enabling a common reciprocating motion according to said predetermined distance to be imparted to the assembly of arrangements such that, during operation in a first position of the assembly, said first material gripping arrangement is positioned adjacent said insertion position means so as to grip a first item of material to be printed along an edge of said first item of material transverse to said reciprocating motion and said second material gripping arrangement is positioned adjacent said printing table so as to grip from said printing table a second item of material along an edge of said second item of material transverse to said reciprocating motion, and in a second position of the assembly where said first material gripping arrangement is positioned adjacent the printing table so as to deliver table at the printing position and said second material gripping arrangement is positioned adjacent a delivery position so as to deliver and release the second item of material at said delivery position, said reciprocating motion returning said assembly to said first position; said first material gripping arrangement having a smooth and planar upper surface which lies approximately in said common plane throughout said reciprocating motion, said printing table at said lower position permitting said first material gripping arrangement to pass across and over said printing table as said assembly moves between said first and second positions.

2. The stencil printing machine according to claim 1, wherein said first and second material gripping arrangements are positioned at an equal height above said bar so that they both remain approximately in said common plane throughout said reciprocating motion, said printing table being raised to said printing position after said assembly of arrangements arrives at said second position to receive material from said first material gripping arrangement, said printing table being raised to said printing position after said assembly of arrangements returns to said first position to present material to said second material gripping arrangement.

3. The stencil printing machine according to claim 2 having a pair of said beams and said first and second material gripping arrangements comprise parallel gripper bars transverse to said beams.

* * * * *